US009127470B2

(12) United States Patent
Lee

(10) Patent No.: US 9,127,470 B2
(45) Date of Patent: Sep. 8, 2015

(54) INTERGRADED DIALYSIS UNIT MODULE AND MODULE COMPARTMENT STRUCTURE

(71) Applicant: Stanley Shao-Ying Lee, Taipei (TW)

(72) Inventor: Stanley Shao-Ying Lee, Taipei (TW)

( * ) Notice: Subject to any disclaimer, the term of this patent is extended or adjusted under 35 U.S.C. 154(b) by 0 days.

(21) Appl. No.: 13/949,956

(22) Filed: Jul. 24, 2013

(65) Prior Publication Data

US 2014/0290151 A1 Oct. 2, 2014

(30) Foreign Application Priority Data

Apr. 1, 2013 (TW) ..... 102206005 U

(51) Int. Cl.

| | |
|---|---|
| ***E04H 1/00*** | (2006.01) |
| ***E04H 3/08*** | (2006.01) |
| ***E04B 2/74*** | (2006.01) |
| *A61G 12/00* | (2006.01) |

(52) U.S. Cl.

CPC .. *E04H 3/08* (2013.01); *E04B 2/74* (2013.01); *A61G 12/002* (2013.01); *E04B 2002/7498* (2013.01)

(58) Field of Classification Search

CPC ... E04B 2/7422; E04B 2/7427; E04B 2/7429; E04B 2/7431; E04B 2/74; E04B 2002/7498; A61G 12/002

USPC ..... 52/29, 36.1, 220.7, 239, 243.1; 160/135, 219, 220, 229.1

See application file for complete search history.

(56) References Cited

U.S. PATENT DOCUMENTS 1,706,388 A * 3/1929 Ashkenas ..... 160/135
1,981,239 A * 11/1934 Manske ..... 52/220.7

(Continued)

FOREIGN PATENT DOCUMENTS

CH 651893 A5 * 10/1985 ..... F16B 5/00
DE 2258006 A1 * 5/1974

(Continued)

*Primary Examiner* — Adriana Figueroa

(74) *Attorney, Agent, or Firm* — Birch, Stewart, Kolasch & Birch, LLP

(57) ABSTRACT

A unit module compartment structure includes: a first unit module compartment, including a first partition board having connection means at one end, and a second partition board having connection means at two ends thereof, respectively, the connection means of the first partition board and the connection means at one end of the second partition board being connected so as to form a first angle less than 90°; and a second unit module compartment, including a third partition board having connection means at one end, and a fourth partition board having connection means at two ends thereof, respectively, wherein the connection means at one end of the third partition board, the connection means at one end of the fourth partition board and the connection means at another end of the second partition board are connected so as to form a second angle identical with the first angle.

14 Claims, 6 Drawing Sheets

(56) References Cited

U.S. PATENT DOCUMENTS

| | | | | | |
|---|---|---|---|---|---|
| 3,017,969 | A | * | 1/1962 | Nielsen | 52/239 |
| 3,404,706 | A | * | 10/1968 | D Esopo | 138/163 |
| 3,463,218 | A | * | 8/1969 | Byrens et al. | 160/135 |
| 3,592,289 | A | * | 7/1971 | Aysta et al. | 160/135 |
| 3,759,297 | A | * | 9/1973 | Anderson et al. | 138/156 |
| 4,566,211 | A | * | 1/1986 | Gustafson et al. | 40/605 |
| 4,569,163 | A | * | 2/1986 | Long | 52/36.1 |
| 4,874,322 | A | * | 10/1989 | Dola et al. | 439/210 |
| 4,986,330 | A | * | 1/1991 | McGonagle | 160/135 |
| 5,782,045 | A | * | 7/1998 | Paschal | 52/220.8 |
| 6,145,253 | A | * | 11/2000 | Gallant et al. | 52/36.1 |
| 6,405,491 | B1 | * | 6/2002 | Gallant | 52/36.1 |
| 7,741,568 | B2 | * | 6/2010 | Makwinski et al. | 174/480 |
| 8,215,065 | B2 | * | 7/2012 | Gallant | 52/36.1 |
| D691,402 | S | * | 10/2013 | Parker | D6/643.1 |

FOREIGN PATENT DOCUMENTS

| | | | | | |
|---|---|---|---|---|---|
| DE | 3600933 | A1 | * | 7/1987 | E04B 2/74 |
| DE | 29516614 | U1 | * | 2/1997 | |
| GB | 1356092 | A | * | 6/1974 | |
| GB | 2144196 | A | * | 2/1985 | F16B 12/02 |
| JP | 2003205031 | A | * | 7/2003 | A61M 1/28 |
| WO | WO 03001002 | A1 | * | 1/2003 | |

* cited by examiner

INTERGRADED DIALYSIS UNIT MODULE AND MODULE COMPARTMENT STRUCTURE

BACKGROUND OF THE INVENTION

1. Field of the Invention

The present invention relates to an intergraded dialysis unit module and module compartment structure provided for hemodialysis centers or hospitals with concern of personal privacy, having merits in structural simplification and convenient care for patients.

2. Description of Related Art

Generally speaking, interior design for hemodialysis centers or hospitals' emergency rooms always adopts open type such that hospital beds are arrayed on a space without compartments. Therefore, medical personnel can observe situations of all patients in beds without obstructing sight lines from nursing stations so as to reduce manpower demand for nursing staff in care. Nevertheless, the beds are arranged in arrays and there is no individual privacy space, and very often disturbance comes from neighboring conversation and noise.

Currently, interior design for hemodialysis centers or hospitals' emergency rooms adopts open type so as to facilitate observation for patients. In order to care for patents' privacy, curtains or screens are supplied, if necessary, for shelter. This, however, is far away from provision of personal privacy space for every individual sick in hospital beds. In particular, lengthy working time needs to be consumed in completion of facilities for power and water supply, together with drainage, such are required for dialysis machines.

According to the present invention, an intergraded dialysis unit module is provided in response to convenient observation for patients at hemodialysis centers or hospitals. This not only satisfies the requirement for medical personnel in convenient care and manipulation, but also provides patients with individual privacy space. In the meantime, power and water supply required for medical equipment such as dialysis machines can be integrated altogether. These can be finished easily by fixed or detachable arrangement, so that not only working hours for compartment can be reduced, but also location of compartment can be changed as necessary.

To solve the above-mentioned problem, a well-designed "intergraded dialysis unit module," according to the present invention, has been accomplished. Such unit modules can be assembled, as desired, for necessities of compartment so as to provide patients with individual privacy space, and to provide with convenient observation for medical personnel at nursing stations. This also integrates power and water supply required for medical equipment, and facilitates medical care and manipulation for medical personnel. The structural design for intergraded assembly has merits not only in reducing working hours for assembly of compartment, but also in changes of styles and sizes of the compartment to meet the variation of locations.

SUMMARY OF THE INVENTION

An object of the present invention is to provide a first unit module compartment comprising a first partition board having connection means at one end, and a second partition board having connection means at two ends thereof, respectively. The connection means of the first partition board and the connection means at one end of the second partition board are connected with each other so as to form a first angle less than 90° but greater than 45°, and preferably 60°, included between the first partition board and the second partition board.

Another object of the present invention is to provide a unit module compartment structure comprising a second or more unit module compartments, where the second unit module compartment includes a third partition board having connection means at one end, and a fourth partition board having connection means at two ends thereof, respectively. The connection means at one end of the third partition board and the connection means at one end of the fourth partition board and the connection means at another end of the second partition board are connected with each other so as to form a second angle less than 90° but greater than 45°, and preferably 60°, included between the third partition board and the fourth partition board such that the first partition board and the third partition board maintain parallel with each other.

Still another object of the present invention is to provide an intergraded dialysis unit module comprising the unit module compartments including sitting or lying facilities such as hospital beds or lounges, a piping box, piping including an inlet pipe and an outlet pipe, a socket panel, and a relevant medical instrument such as a dialysis machine. These will constitute the intergraded dialysis unit module so as to provide patients in each individual unit module compartment a privacy medical space.

According to the present invention, since the partition boards are included at an angle less than 90° but greater than 45°, and preferably 60°, medical personnel at the nursing station will not have their sight lines obstructed by the partition boards so that the medical personnel can observe situation of each patient in the unit module compartment sitting or lying on the patient bed or lounge and ensure attendance for the patient during medical treatment.

Further, according to the present invention, a plurality of unit module compartments can be combined together so as to satisfy demands of hospitals or hemodialysis centers in partitioning patients sitting or lying in hospital beds or lounges. The unit module compartments are combined in a single or double row so as to form an intergraded unit module compartment structure arrayed in a herringbone arrangement. Therefore, medical personnel from the nursing stations are able to observe situations of the patients sitting or lying on the patent beds or lounges so as to reduce the number of nursing staff.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
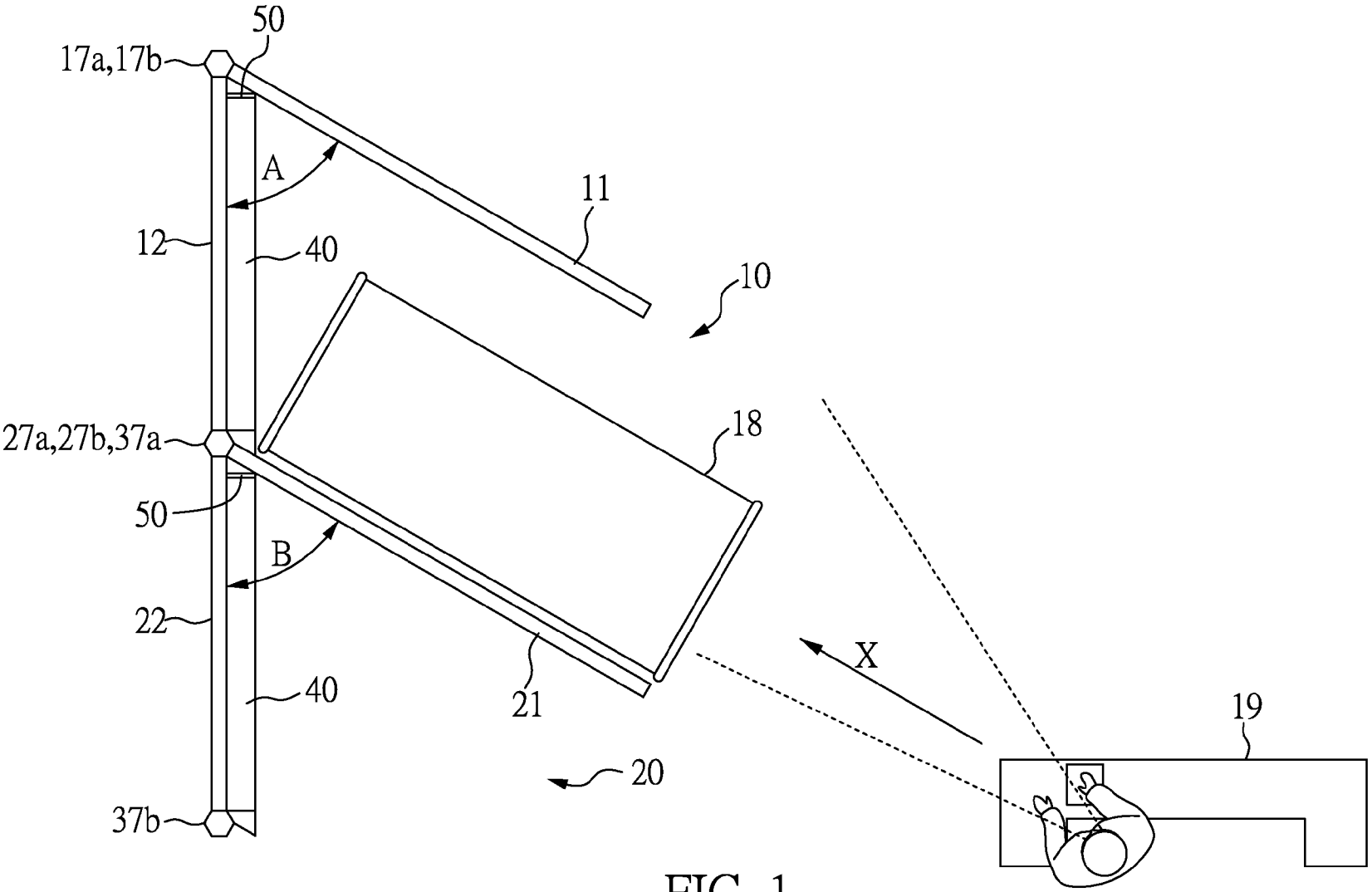
FIG. 1 is a schematic top view illustrating a unit module compartment structure according to the present invention.
Figure 2:
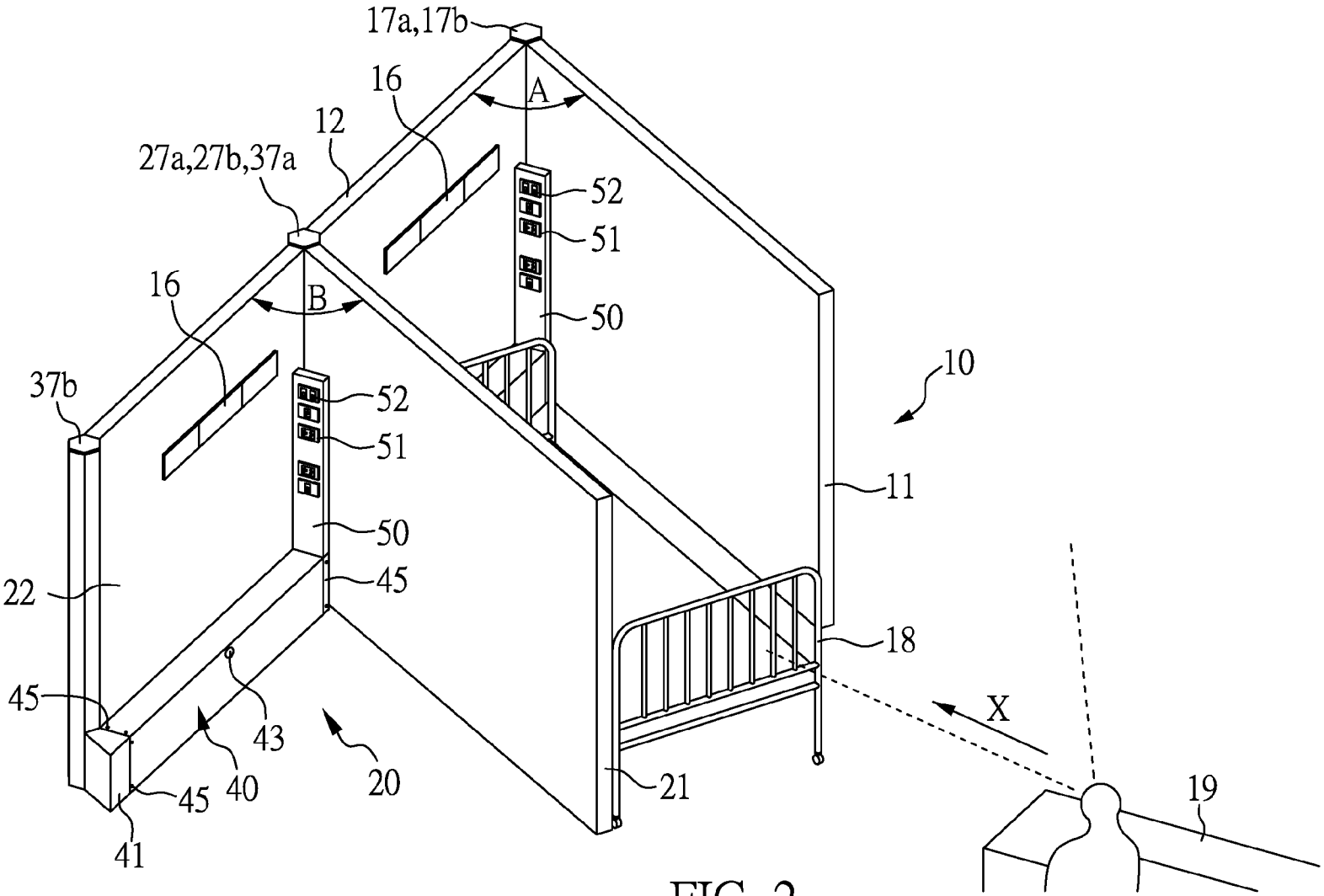
FIG. 2 is a schematic perspective view illustrating the unit module compartment structure according to the present invention.
Figure 3:
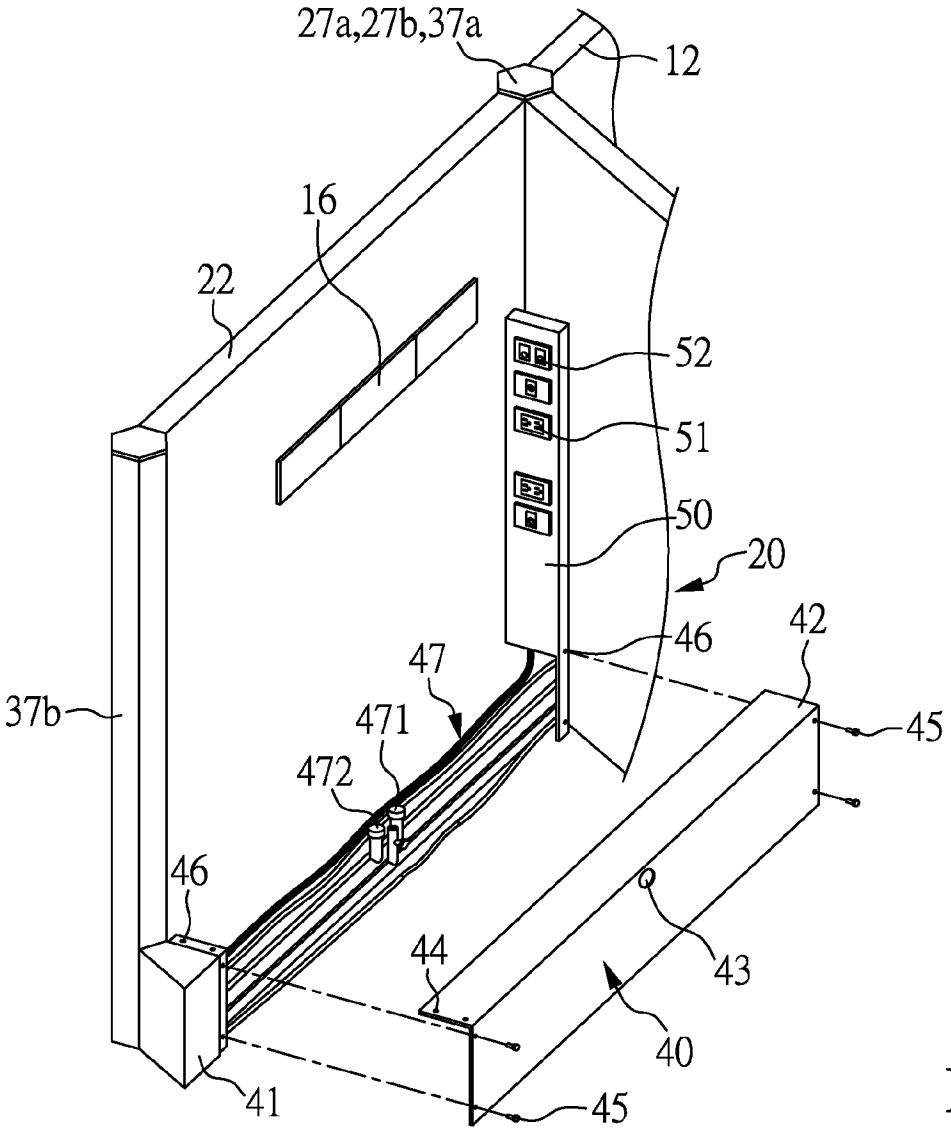
FIG. 3 is a schematic view illustrating part of the unit module compartment structure, according to the present invention, arranged with a piping box and a socket panel.

Referring to FIGS. 1, 2 and 3, a unit module compartment structure, according to the present invention, comprises a plurality of unit module compartments including a first unit module compartment 10 and a second unit module compartment 20. The first unit module compartment 10 includes a first partition board 11 and a second partition board 12, wherein the first partition board 11 is provided, at its one end, with connection means 17*a*; whereas the second partition board 12 is provided, at its two ends, with connection means 17*b*, 27*b*, respectively. The connection means 17*a* and the connection means 17*b* are connected with each other so as to form a first angle A less than 90° between the first partition board 11 and the second partition board 12, for example, greater than 45° but less than 90° and preferably 60°; or less than 45°. According to the present invention, the manner the connection means 17*a*, 17*b*, 27*b* may be fixed to the first and second partition boards 11, 12 by connection or joining technique or devices, including but not limited to adhesive, welding, screws, or equivalents, or their combination.

According to the present invention, as shown in FIGS. 1 and 2, the second unit module compartment 20 includes a third partition board 21 and a fourth partition board 22, wherein the third partition board 11 is provided, at its one end, with connection means 27*a*; whereas the fourth partition board 22 is provided, at its two ends, with connection means 37*a*, 37*b*, respectively. The connection means 27*a* and the connection means 37*a*, together with the connections 27*b*, are connected with each other so as to form a second angle B, which is identical with the first angle A and which is less than 90°, between the third partition board 21 and the fourth partition board 22, making the first partition board 11 and the third partition board 21 parallel with each other. To combine all the first unit module compartment 10, the second unit module compartment 20 (and so forth), an intergraded unit module structure can be formed so as to provide patients with an isolated personal privacy space.

Figure 2A:
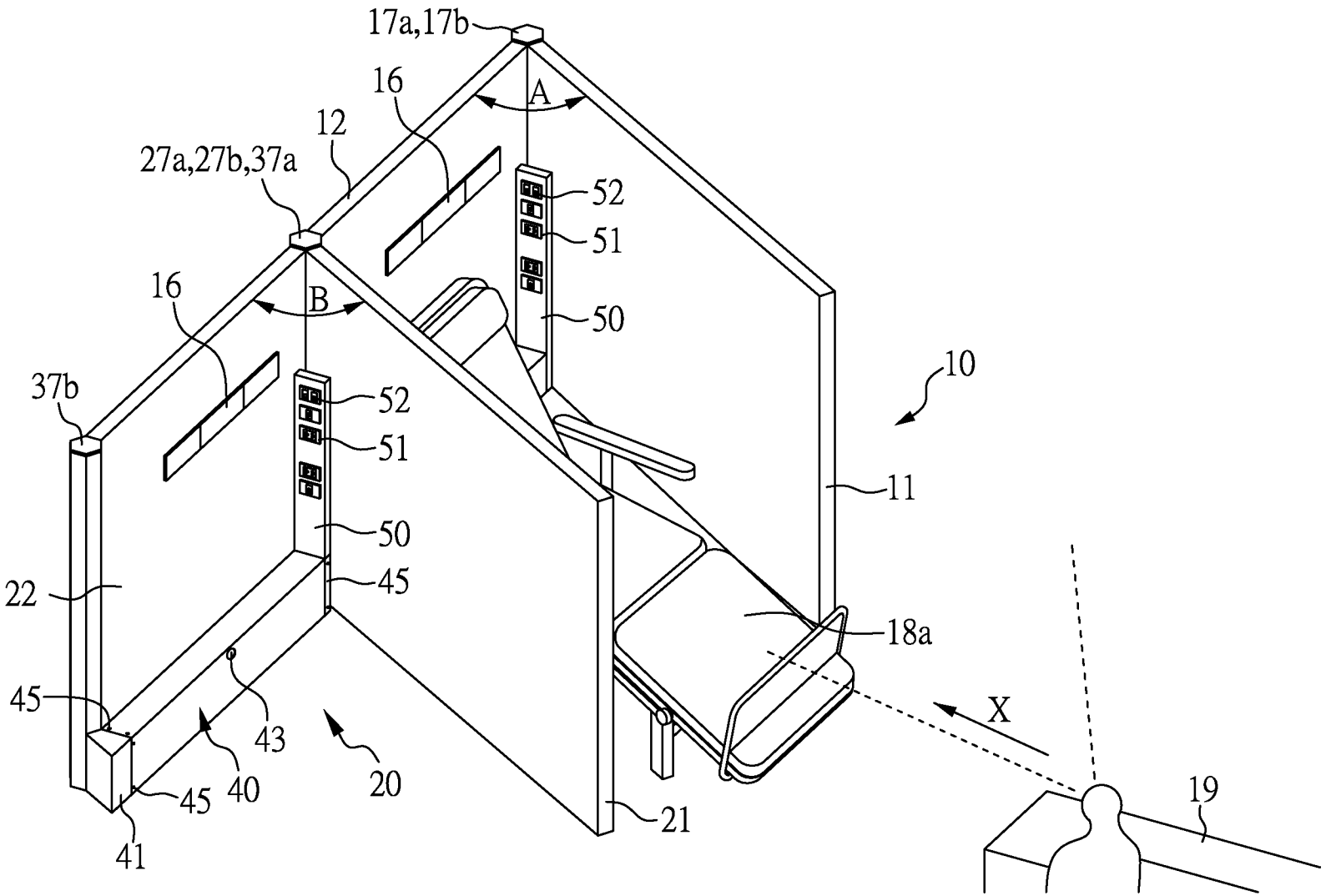
FIG. 2*a* is a schematic perspective view illustrating the unit module compartment structure, in which a hospital bed shown in FIG. 2 is replaced with a lounge, according to the present invention.
Figure 5:
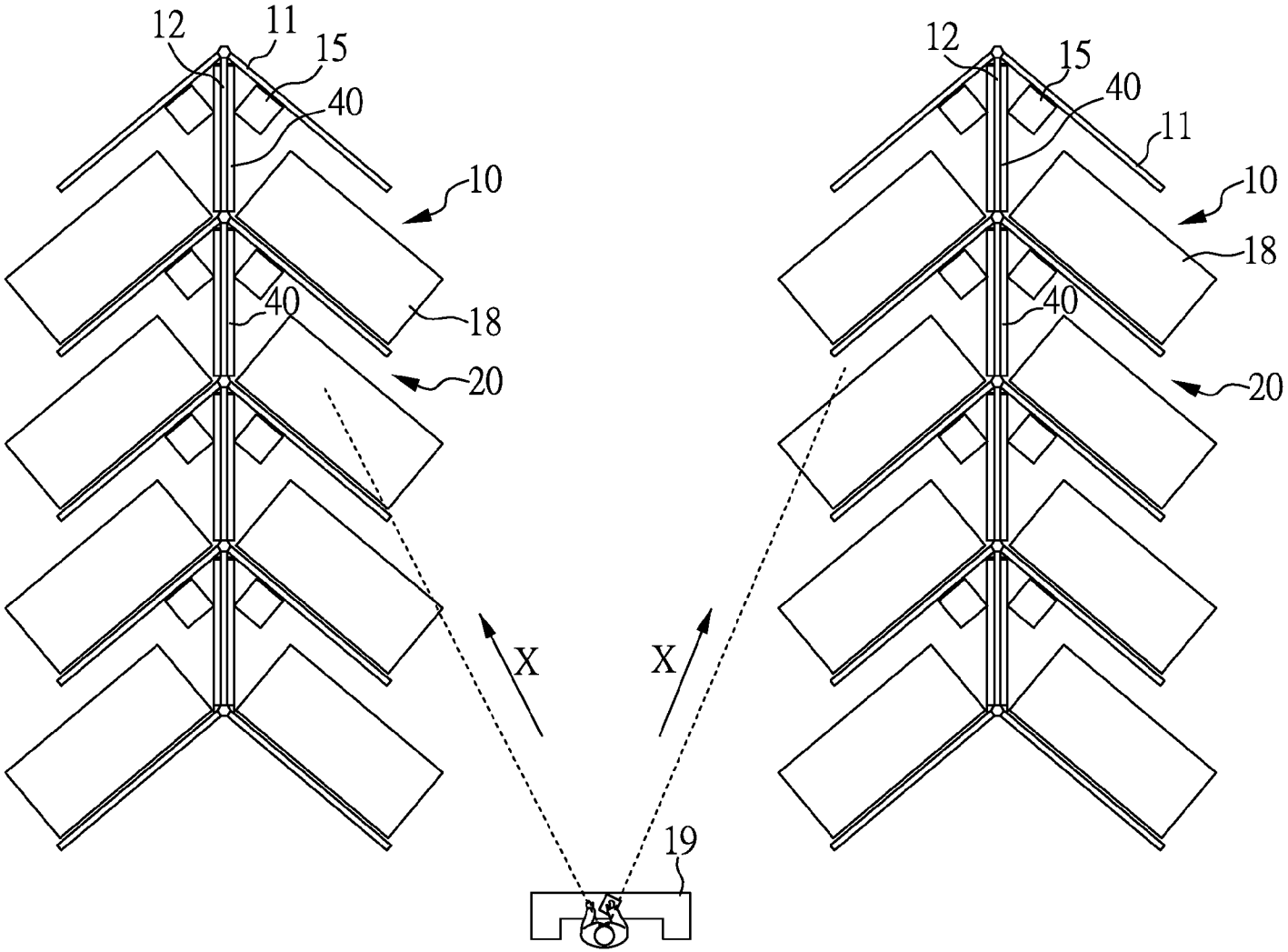
FIG. 5 is a schematic top view illustrating an overall arrangement of the intergraded dialysis unit module compartment structure according to the present invention.

Further, according to the present invention, as shown in FIGS. 1, 2 and 3, the unit module compartments 10, 20 each includes sitting or lying facilities such as a hospital bed 18 or lounge 18*a* (see FIG. 2*a*), a lighting fixture 16 arranged on the second partition board 12 and the fourth partition board 22, respectively, and a relevant medical instrument such as a dialysis machine 15 (see FIG. 5). Since the partition boards 11, 12 or 21, 22 are included at an angle less than 90°, medical personnel at the nursing station 19 will not have their sight lines X obstructed by the partition boards 11, 12, 21, 22, so that the medical personnel can observe each patient conveniently and ensure attendance for the patients during medical treatment.

Still further, as shown in FIGS. 1, 2, and 3, the unit model compartment structure is equipped with water and electricity piping, together with sockets, as required. For example, a piping box 40 is provided along the lower portion of the second partition board 12 and of the fourth partition board 22; and a socket panel 50 is provided between the first partition board 11 and the second partition board 12, and between the third partition board 21 and the fourth partition board 22, respectively. Of course, to simplify the construction, both the piping box 40 and the socket panel 50 can only be arranged on the second partition board 12 and the fourth partition board 22, respectively. The piping box 40 includes a position post 41 and a cover 42, where the position post 41 is fixed at one side of the partition board 22. Screws 45 pass through holes 44 of the cover 42 and are threaded into the position post 41, and into the threaded holes 46 of the socket panel 50. Therefore, piping (including an inlet pipe 471 and an outlet pipe 472) and wire tubes 47 can be concealed inside of the piping box 40. The cover 42 is provided with an inlet/outlet hole for passing therethrough the inlet pipe 471 and the outlet pipe 472, where the inlet pipe 471 and the outlet pipe 472 are connected to medical facilities 15 for dialysis. In addition, the socket panel 50 may be provided with such as electric switches 52, electric outlets 51, and so forth.

Figure 4:
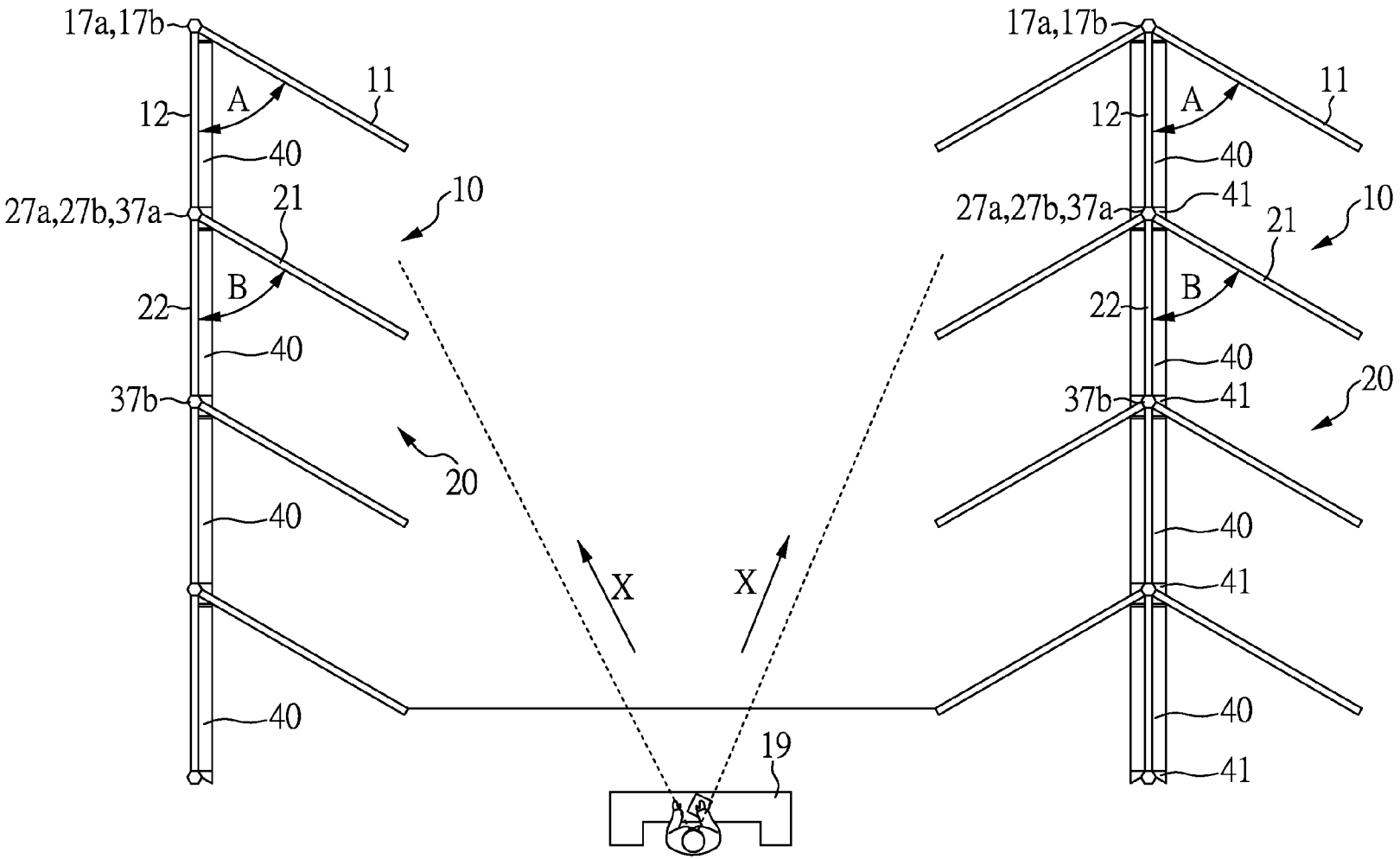
FIG. 4 is a schematic view illustrating an intergraded unit module compartment structure formed in a single row, and in a double row as a herringbone arrangement, by a plurality of unit module compartment according to the present invention.

Referring to FIG. 4, a plurality of unit module compartments 10, 20 (and so forth) can be combined together in a single or double row so as to form an intergraded unit module compartment structure arrayed in a herringbone arrangement. Further, as shown in FIG. 5, the unit module compartment structures are arranged in an overall scale, wherein medical facilities for dialysis 15 are well equipped, together with hospital beds or lounges to meet the need for sitting or lying patients. This will satisfy hospitals or hemodialysis centers demands of caring for several patents in the meantime so as to reduce the number of nursing staff.

Generally speaking, according to the present invention, electric power supply is provided on appropriate locations of the partition boards for utilization of medical facilities or lighting. In addition, water supply or draining facilities are provided at appropriate locations underneath the partition boards for cleansing and flushing and for utilization of the medical facilities required for dialysis. Also, shelves and lighting fixture can be arranged at appropriate locations of the partition boards, so that patients can place goods thereon or medical personnel can place medical appliances thereon during medical practices. Besides, monitors can be arranged on appropriate locations of the partition boards so as to provide convenient observation for medical personnel at nursing stations. Likewise, intercom can be arranged at appropriate locations of the partition boards for communications with the nursing stations.

Further, the unit module compartment, according to the present invention, can be employed in hemodialysis centers, hemodialysis rooms, or hospitals as partitions in which hospital beds or lounges are furnished. Still further, the unit module compartment, according to the present invention, can be employed in sites such as emergency rooms, temporary medical or nursing locations, field hospitals, and so forth.

Although the present invention has been explained in relation to its preferred embodiments, it is to be understood that many other possible modifications and variations can be made without departing from the scope of the invention as hereinafter claimed.

What is claimed is:

1. A unit module compartment structure, comprising:

a first unit module compartment, including a first partition board having connection means at one end, and a second partition board having connection means at two ends thereof, respectively, the connection means of the first partition board and the connection means at one end of the second partition board being connected with each other so as to form a first angle less than 90° between the first partition board and the second partition board;

a second unit module compartment, including a third partition board having connection means at one end, and a fourth partition board having connection means at two ends thereof, respectively, wherein the connection means at one end of the third partition board and the connection means at one end of the fourth partition board and the connection means at another end of the second partition board are connected with each other so as to form a second angle less than 90°, identical with the first angle, between the third partition board and the fourth partition board such that the first partition board and the third partition board maintain parallel with each other; and a piping box located in the first unit module compartment and arranged on and outside the second partition board, the piping box including a cover and a position post, wherein the position post has a first side in contact with the connection means of the second unit module compartment, a second side facing the third partition board, a third side in contact with one end of the cover, and a fourth side in parallel with the second partition board, the second side and the fourth side of the position post form a third angle identical with the first angle, and the first side, the second side, the third side and the fourth side of the position post forms a quadrangle, wherein the unit module compartment structure further comprises a first connecting post and a second connection post, each of the first and second connecting posts being a hexagon cylinder with a six-sided circumferential sidewall, and wherein the first and second partition boards are attached to two immediate adjacent sides of the six-sided circumferential sidewall of the first connecting post through respective connection means, the third and fourth partition boards are attached to two immediate adjacent sides of the six-sided circumferential sidewall of the second connecting post through respective connection means, and the second and third partition boards are attached to two sides, which are not immediately adjacent and spaced apart by one side, of the six-sided circumferential sidewall of the second connecting post through respective connection means.

2. The unit module compartment structure as claimed in claim 1, further comprising a plurality of unit module compartments combined in a single row so as to form an intergraded unit module compartment structure.

3. The unit module compartment structure as claimed in claim 1, further comprising a plurality of unit module compartments combined in a double row so as to form an intergraded unit module compartment structure arrayed in a herringbone arrangement.

4. The unit module compartment structure as claimed in claim 1, wherein the first angle formed between the first partition board and the second partition board is less than 90° but greater than 45°.

5. The unit module compartment structure as claimed in claim 1, wherein the first angle formed between the first partition board and the second partition board is 60°.

6. The unit module compartment structure as claimed in claim 1, wherein the first angle formed between the first partition board and the second partition board is less than 45°.

7. An intergraded dialysis unit module, comprising:

a first unit module compartment, including a first partition board having connection means at one end, and a second partition board having connection means at two ends thereof, respectively, the connection means of the first partition board and the connection means at one end of the second partition board being connected with each other so as to form a first angle less than 90° between the first partition board and the second partition board;

a second unit module compartment, including a third partition board having connection means at one end, and a fourth partition board having connection means at two ends thereof, respectively, wherein the connection means at one end of the third partition board and the connection means at one end of the fourth partition board and the connection means at another end of the second partition board are connected with each other so as to form a second angle less than 90°, identical with the first angle, between the third partition board and the fourth partition board such that the first partition board and the third partition board maintain parallel with each other;

a piping box located in the first unit module compartment and arranged on and outside the second partition board, the piping box including a cover and a position post, wherein the position post has a first side in contact with the connection means of the second unit module compartment, a second side facing the third partition board, a third side in contact with one end of the cover, and a fourth side in parallel with the second partition board, the second side and the fourth side of the position post form a third angle identical with the first angle, and the first side, the second side, the third side and the fourth side of the position post forms a quadrangle;

at least one sitting or lying facility for patients arranged in each of the unit module compartments, and a medical instrument for dialysis arranged in each of the unit module compartments; and a medical facility for dialysis, equipped in each of the unit module compartment, wherein the unit module compartment structure further comprises a first connecting post and a second connection post, each of the first and second connecting posts being a hexagon cylinder with a six-sided circumferential sidewall, and wherein the first and second partition boards are attached to two immediate adjacent sides of the six-sided circumferential sidewall of the first connecting post through respective connection means, the third and fourth partition boards are attached to two immediate adjacent sides of the six-sided circumferential sidewall of the second connecting post through respective connection means, and the second and third partition boards are attached to two sides, which are not immediately adjacent and spaced apart by one side, of the six-sided circumferential sidewall of the second connecting post through respective connection means.

8. The intergraded dialysis unit module as claimed in claim 7, further comprising a lighting fixture arranged on the second partition board and the fourth partition board, respectively.

9. The intergraded dialysis unit module as claimed in claim 7, further comprising a socket panel arranged on each of the second partition board and the fourth partition board.

10. The intergraded dialysis unit module as claimed in claim 7, wherein the piping box includes an inlet pipe and an outlet pipe.

11. The intergraded dialysis unit module as claimed in claim 10, wherein the inlet pipe and the outlet pipe are provided for connecting the medical facility for dialysis.

12. The intergraded dialysis unit module as claimed in claim 7, further comprising a socket panel provided between the first partition board and the second partition board, and between the third partition board and the fourth partition board, respectively.

13. The intergraded dialysis unit module as claimed in claim 7, wherein the at least one sitting or lying facility for patients relates to a hospital bed or lounge.

14. The intergraded dialysis unit module as claimed in claim 7, wherein the medical facility for dialysis includes a dialysis machine.

* * * * *